US008835840B1

(12) United States Patent
Lynn et al.

(10) Patent No.: US 8,835,840 B1
(45) Date of Patent: Sep. 16, 2014

(54) POSITRON STORAGE MICRO-TRAP ARRAY

(75) Inventors: Kelvin G. Lynn, Pullman, WA (US); Marc H. Weber, Pullman, WA (US)

(73) Assignee: Washington State University, Pullman, WA (US)

( * ) Notice: Subject to any disclaimer, the term of this patent is extended or adjusted under 35 U.S.C. 154(b) by 751 days.

(21) Appl. No.: 12/886,412

(22) Filed: Sep. 20, 2010

Related U.S. Application Data

(60) Provisional application No. 61/276,971, filed on Sep. 18, 2009.

(51) Int. Cl.
*H01J 49/42* (2006.01)
*H01J 49/38* (2006.01)

(52) U.S. Cl.
CPC ..... *H01J 49/424* (2013.01); *H01J 49/38* (2013.01)
USPC ..... 250/292; 250/291; 250/281

(58) Field of Classification Search
CPC . H01J 49/424; H01J 49/4245; H01J 49/4255; H01J 49/4295
See application file for complete search history.

(56) References Cited

U.S. PATENT DOCUMENTS

| | | | | |
|---|---|---|---|---|
| 6,469,298 | B1 * | 10/2002 | Ramsey et al. | 250/292 |
| 6,870,158 | B1 * | 3/2005 | Blain | 250/292 |
| 6,967,326 | B2 * | 11/2005 | Pai et al. | 250/292 |
| 7,582,867 | B2 * | 9/2009 | Wells et al. | 250/292 |

OTHER PUBLICATIONS

Surko et al., "A multicell trap to confine large numbers of positrons", Radiation Physics and Chemistry 68 (2003) 419-425.*
Greaves et al., "Creation and uses of positron plasmas," Physics of Plasmas 1, 1439-1446 Part 2 (1994).
Danielson et al., "Plasma manipulation techniques for positron storage in a multicell trap," Physics of Plasmas 13, 123502-2-123502-10 (2006).

* cited by examiner

*Primary Examiner* — Jack Berman
(74) *Attorney, Agent, or Firm* — Klarquist Sparkman, LLP

(57) ABSTRACT

Micromachined holes in stacks of silicon wafers can be used to define high aspect ratio charged particle storage volumes. Each wafer can define a section of a tubular trap, and electric fields in each wafer can be controlled independently so that charged particles can be stored and shuttled among the sections.

19 Claims, 6 Drawing Sheets

FIG. 1D
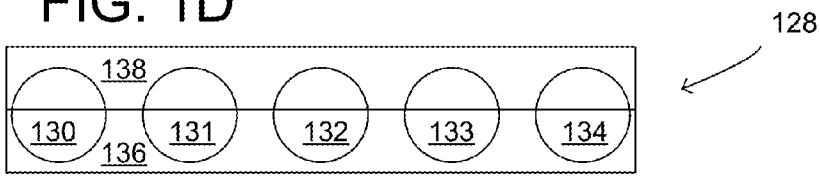
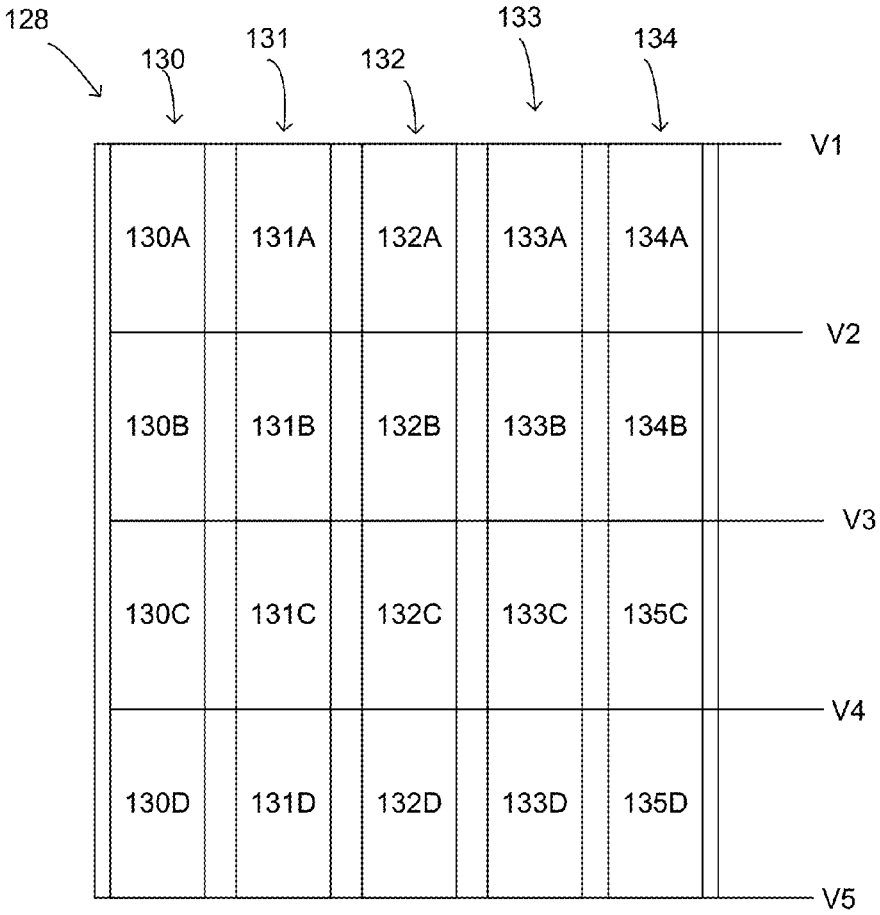
FIG. 1E

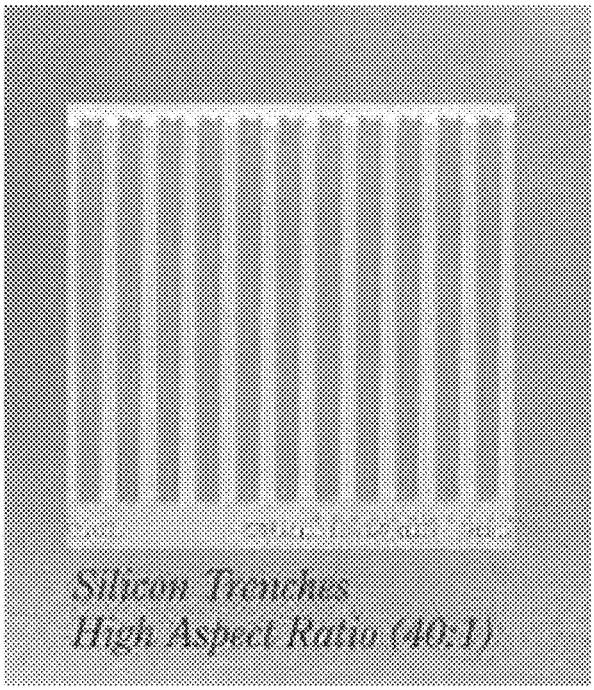
FIG. 2
FIG. 3
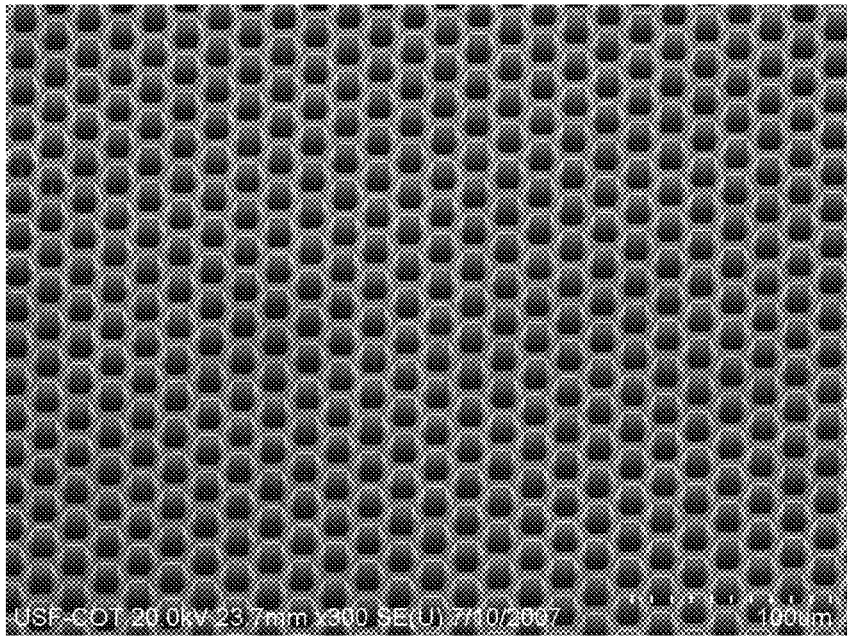

POSITRON STORAGE MICRO-TRAP ARRAY

CROSS REFERENCE TO RELATED APPLICATION

This application claims the benefit of U.S. Provisional Application 61/276,971, filed Sep. 18, 2009 which is incorporated herein by reference.

ACKNOWLEDGMENT OF GOVERNMENT SUPPORT

This invention was made with government support under Contract No. W9113M-09-C-0075 awarded by the US Army Space and Missile Defense Command and administered by the Army Research Laboratory beginning Jul. 20, 2010. The government has certain rights in the invention.

FIELD

The disclosure pertains to charged particle storage.

BACKGROUND

Potential uses for positrons and other trapped charged particles have not been practically realized to date. For example, positron annihilation can be used to convert the mass of an electron-positron pair into electromagnetic radiation. Compared to the most efficient chemical and nuclear energy sources, annihilation produces substantially more energy per unit mass. Unfortunately, there are no practical existent storage methods for positrons. Other applications requiring positrons also must rely on expensive, complex sources that often present substantial radiation safety hazards. Thus, improved charged particle storage methods and apparatus are needed.

SUMMARY

Charged particle storage devices include a plurality of substrates, each substrate defining a plurality of through apertures from a first surface to an oppositely situated second surface. The substrates are stacked and bonded so that a plurality of the through apertures from each substrate aligns to define a plurality of through apertures extending through the stack of substrates from a first exterior surface oppositely situated with respect to a second exterior surface. Typically, the through apertures have aspect ratios of at least 25, and electrically conductive layers are situated at the first and second exterior surfaces. In some examples, each of the substrate through apertures includes a conductive interior surface. In other examples, electrically conductive layers are situated at the first and second surfaces of each of the plurality of substrates, and electrically coupled so that different voltages can be established along the apertures of each substrate. In further embodiments, the aspect ratio is at least 50, and an effective diameter of the though apertures is less than 100 micrometers or 50 micrometers.

Devices comprising tubular voids defined in a plurality of stacked substrates, the tubular voids extending along an axis from a first surface to second surface that are substantially perpendicular to the axis. Each of the stacked substrates defines a section of the tubular void, wherein the tubular sections have an aspect ratio of at least 20 and an effective diameter of less than 125 micrometers. Conductive layers situated at the first and second surface and configured to establish an electric field along the axis. In some examples, the aspect ratio is at least 50 and the effective diameter is less than 100 micrometers. In further examples, a plurality of tubular voids defined in the plurality of stacked substrates is provided, the tubular voids extending along the axis, wherein each of the stacked substrates defines a section of a corresponding tubular void. In other embodiments, electrically independent conductive layers are situated at the first and second surfaces of the plurality of substrates. In other alternatives, the substrates are silicon substrates having thicknesses of less than 2 mm, 1 mm, or 0.5 mm, and the effective diameter is less than 75 micrometers. In representative embodiments, each of the stacked substrates defines at least 100, 1000, or 10,000 tubular void sections. In some examples, a cross section of the tubular void sections is circular or hexagonal, and each of the tubular voids is surrounded by a conductive layer that extends along the axis.

Charged particle storage devices include devices based on such assemblies of tubular voids in a substrate stack, and typically further include a magnet configured to establish a magnetic field along the axis, and a voltage controller configured to supply at least one voltage so as to define axial electric fields in each of the tubular sections. The magnet is typically a superconducting magnet, and the voltage controller is configured to establish axial electric fields that differ in magnitude and sign in each substrate so that charged particles can be stored, shuttled among sections, or exported.

Methods comprise forming a plurality of recesses that extend between opposing surfaces of a wafer substrate, and bonding a plurality of such wafer substrates to form a stack. In bonding, the recesses in each wafer are aligned to form a plurality of through holes extending through the stack along an axis. Conductive layers are formed at opposing surfaces of the wafer stack that are substantially perpendicular to the axis.

The foregoing and other objects, features, and advantages of the disclosed technology will become more apparent from the following detailed description, which proceeds with reference to the accompanying figures.

BRIEF DESCRIPTION OF THE DRAWINGS

FIG. 1D is a end view of a one-dimensional array of charged particle trap tubes.

FIG. 1E is a plan view of the one dimensional array of FIG. 1D.

FIG. 2 is an electron micrograph of trenches in a silicon wafer for formation of trap tubes. As shown in FIG. 2, trench width is about 100 micrometers.

FIG. 3 is an electron micrograph of hexagonal holes in a silicon wafer that can define trap tube sections. In FIG. 3, effective hole diameter is about 100 micrometers, and sidewall thickness (hole separation) is about 3 micrometers.

DETAILED DESCRIPTION

Figure 1A:
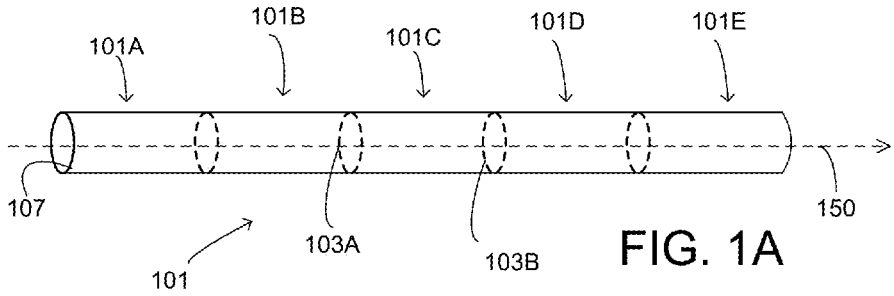
FIG. 1A is a perspective view of a sectioned charged particle trap tube.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular sequential order for convenient presentation, it should be understood that this manner of description encompasses rearrangement, unless a particular ordering is required by specific language set forth below. For example, operations described sequentially may in some cases be rearranged or performed concurrently. For the sake of simplicity, the attached figures may not show the various ways in which the disclosed systems, methods, and apparatus can be used in conjunction with other systems, methods, and apparatus. The description sometimes uses terms such as "produce" and "provide" to describe the disclosed methods. These terms are high-level abstractions of the actual operations that are performed. The actual operations that correspond to these terms will vary depending on the particular implementation and are readily discernible by one of ordinary skill in the art.

Theories of operation, scientific principles, and theoretical descriptions presented herein in reference to the apparatus and methods of this disclosure have been provided for the purposes of better understanding, and are not intended to be limiting in scope. The apparatus and methods in the appended claims are not limited to those apparatus and methods that function according to scientific principles and theoretical descriptions presented herein.

As used in this application and in the claims, the singular forms "a," "an," and "the" include the plural forms unless the context clearly dictates otherwise. The term "includes" means "comprises." The term "coupled" means mechanically, electrically, electromagnetically, or optically coupled or linked and does not exclude the presence of intermediate elements between the coupled items.

There are known methods that provide means for the shuttling and short term storage of charged ions and other charged particles. Implementations of such methods are generally limited to their use within scientific instrumentation for the purpose of material analysis or fundamental studies of material properties. Herein we disclose devices and methods for the long term storage of charged particles or ions that provide means for the use of the ions or particles for both scientific study and/or other applications over an extended period of time, up to many days. Not only can the disclosed devices provide long term storage, they can be portable as well.

Electric and magnetic fields can be configured so that individual charged particles or a small number thereof can be stored for relatively long times of several months or more. In a static electromagnetic trap, a strong magnetic field forces the particles onto circular orbits around the axis of the magnetic field. Large repulsive electric fields can be applied to turn the particles around at the end of a cylindrical container. Typical examples are so-called Penning traps or Malmberg-Penning traps. Time fluctuating fields also can be used (Paul traps). In such traps, an electric field is rotated rapidly to generate a confining force analogously to forces that confine a water in a bucket as the bucket swing about an axis. While these devices function well for small numbers of particles, complications arise when the density of particles or the total number of particles is increased.

Penning traps are typically intended for applications in which high density plasmas are to be stored at high temperatures. Such traps use a tube to which a homogeneous axial static magnetic field and an inhomogeneous electric field (typically a quadrupole field that can be provided with a ring electrode and two end cap electrodes) are applied to confine charged particles. For investigation of high particle densities near the so-called Brillouin limit at which confining forces match mutual repulsive forces of the confined particles, particle density ρ is limited to $$\rho = \frac{B^2}{8\pi \cdot mc^2},$$

wherein B is the magnetic field in Tesla, m the mass of the stored positrons in kg, and c the speed of light in m/s.

In such conventional traps, an increase in trap diameter allows for confinement of more particles. In plasma research and nuclear fusion, these particles can and must interact with each other to achieve the objective of understanding the plasma, or triggering controlled nuclear fusion. Such trap configurations are described in, for example, Surko and Greaves, "Creation and uses of positron plasmas," Physics of Plasmas 1, 1439-1446 Part 2 (1994), which is incorporated herein by reference. In portable traps, large magnetic fields can be maintained with superconducting magnets as long as coolant is available. The requirements on the confining electric field, on the other hand, need to be sufficiently low to be operated by batteries. In one example, this has been accomplished for a small number of electrons as described in Tseng and Gabriels, "Portable trap carries particles 5000-kilometers," Hyperfine Interactions 76, 381-386 (1993), which is incorporated herein by reference.

While the Brillouin limit is useful in designing for high density plasmas, different conditions are appropriate for long term charge storage in which repulsive forces should be reduced with respect to confining fields to lower the requirements on the confining fields. FIG. 2 shows electrical potentials necessary to prevent axial loss of positrons through end caps as a function of numbers of stored positrons. A minimum required potential Φ (in volts) is a function of the number of confined positrons N, the length of the trap L and the fraction f of the filled diameter is given by.

$$\Phi = 1.4\times10^{-7}\frac{N}{L}(1+2\ln(f^{-1})) = 1.4\times10^{-7}\frac{\pi}{4}f^2(1-2\ln(f))\cdot\rho\cdot d^2 \quad \text{(V)}$$

In a magnetic field of 2 Tesla, the magnetic forces are balanced at a positron density of $2\times10^{13}/\text{cm}^3$. At no more than $10^7$ ($10^8$) positrons per individual trap, the density ρ is less than 1% (10%) of this Brillouin limit. The right hand side of this equation is based on the assumption that the number of stored positrons is distributed across the filled cylinder volume of the trap with a uniform density ρ. For a given density, the length of the trap does not alter the required containment potential Φ. By reducing the diameter of the trap, the required confinement potential drops in proportion to the square of the diameter. Lower numbers of stored particles (for a fixed density) can be compensated by appropriately lengthening the tube.

Disclosed herein are representative charged particle traps suitable for trapping of positrons, ions, and other charged particles based on parallel arrays of large aspect ratio parallel traps. Typical traps have diameters of between about 1-500 microns, and are arranged to be filled in parallel. The disclosed examples refer to storage of positrons, but the disclosed methods and apparatus can be used with other charged particles as well, and positron storage is described as a convenient but useful example. Stored positrons can be used in a variety of energy generation applications that require either rapid, explosive energy release or gradual energy release. Stored positrons or other charged particles for these and other applications can be transported in such traps. In some disclosed examples, $10^4$ or more parallel tubes of ~5-200 μm diameter and up to 50 cm length can be configured to store $10^{11}$ or more positrons. Typically, charged particles in such traps can be confined with magnetic fields of a few Tesla and voltages of 100V, 10V, or less in contrast with the kV levels required by conventional devices.

Typical configurations can be selected based on the following consideration. A charged particle volume (conveniently, a cylindrical volume) can be divided into a multitude of identical or similar parallel tubes. Tube walls (or other conductors situated between the charged particle volumes) can be formed of a metal or other conductor so that image potentials produced by such conductors shield charged in one tube from other tubes. An array of cylinders (or other tubes) of effective diameters of 50 micrometers or less is formed. In certain embodiments, such an array of cylinders is formed in a silicon wafer or other wafer using micro-electro-mechanical methods. A conductive diamagnetic material (e.g. Au, Pt, AL, or other material) is deposited on the individual wafers. In yet further embodiments a bonding layer (e.g., TiW, TiN or other layers) operable to improve the adhesion between the diamagnetic metal and wafer may be deposited prior to deposition of metallic layers. An array of identical holes in such a wafer provides a suitable array of charged particle trap volumes. One or more wafers having such arrays of holes can be stacked so that the holes in the wafers align with each other. In this manner, the aligned holes from the wafer stack from an array of extended tubes that can be substantially longer than a thickness of an individual wafer. In cases where a metal has been deposited on the wafer to provide a conductive coating, the wafer stack is preferably heated to a temperature sufficient to anneal the metal but below the eutectic temperature of both the metal and wafer material. (i.e., 350° C. for gold sputtered onto a silicon wafer). An electrical potential can be applied to the first and last wafers in the stack to provide a confining voltage. In some examples, each wafer can be provided with conductive layers or coatings so that trapping voltages can be applied wafer by wafer and not just to the entire wafer stack. Such an array of micro-machined tubes can hold charged particles at densities similar to those in a single larger tube, but requiring substantially reduced electrical confining forces.

"Trapping electrodes" as used herein are conductors or conductive surfaces that are configured to produce a trapping electric field for trapping or containing ions or charged particles along a z-axis of a trapping cell. The z-axis in a trapping cell typically corresponds to an axis aligned with a magnetic field. In a cylindrically shaped trapping cell, the z-axis corresponds to a central longitudinal axis of the cell. The trapped ions can be considered to be trapped within a potential well generated by the trapping electrodes.

A particular configuration of trapping cells can be selected based on the following considerations. A single large volume trap can store more charge than one narrower trap, but multiple smaller volume, narrower traps can be used to achieve the same charge storage. After increasing the number of narrow traps, break-even will be achieved. For example, break-even occurs when 4 tubes at about 4 times the original single tube length are assembled. Each tube would have ¼ the diameter. An array of such traps could store an equal number of charges at the same density as a single tube trap, but require only 1/16 of the confining potential.

FIG. 1A illustrates a representative charged particle storage tube 101 that includes a sectional tubes 101A-101E that extend along an axis 150. As shown in FIG. 1A, tube 101 has a circular cross section, but ovoid, elliptical, polygonal, annular, or other symmetrical or asymmetrical cross sections can be used. In addition, the sectional tubes 101A-101E are shown as being of the same axial length, but the sections can be all of the same or different lengths. An interior surface 107 is provided with an electrically conductive coating and is coupled so that a suitable electrical potential can be applied. Interior conductive coatings or layers for each of the sections can be electrically coupled to each other, or one or more (or all) section interior surfaces can be electrically isolated. In certain embodiments, electrical isolation of individual wafer segments within a stack is achieved through deposition of a non-conductive thermal oxide film prior to deposition of conductive material thereby providing independently controllable wafers within the wafer stack. Inner surface conductivity can be achieved with surface coatings or other treatments, or wafers used to define the sectioned tube 101. Section tube end faces such as representative end faces 103A, 103B of the section 101C can be configured to include conductive layers so that one or more of the sectional tubes 101A-101E can be independently biased for charged particle storage to transport. Alternatively, conductive layers or plates can be situated between the sectional tubes and coupled to receive suitable voltages for confining, receiving, and transporting charged particles. Although the tube 101 is shown as a cylindrical annulus in FIG. 1A, typically, the sectional tubes are formed as holes or pores in a micromachinable material such as a silicon wafer, and a plurality of such sectional tubes in a plurality of wafers are assembled to form storage tubes such as the storage tube 101. As a result, typical section lengths range from about 0.05 mm to about 0.5 mm but other lengths can be used. Typical tube diameters range from about 1-100 microns. In some examples, hexagonal or other cross sectional areas can be preferred, especially if a wafer that is to be machined to form storage tubes preferentially etches to have a particular cross sectional shape. Overall length of the tube 101 can be determined based on a number of wafers to be stacked.

Figure 1B:
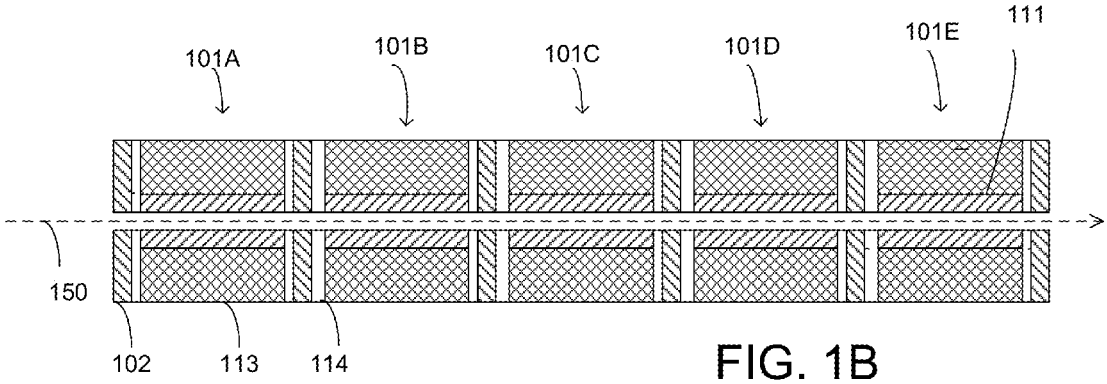
FIG. 1B is a sectional view of the trap tube of FIG. 1A.

Additional alternative details of the sectioned tube 101 are shown in FIG. 1B. A conductive layer such as a conductive layer 111 is situated on an interior surface of some or all of the sections 101A-101E, and end conductors such as end conductor 102 are configured at some or all section ends separated by insulator layers such as insulator layer 114 so that electric fields along the axis 150 can be independently established in each of the sections 101A-101E. The sections 101A-101E are generally defined in substrates such as substrate 113. Convenient insulator layers, especially for silicon wafer based devices include silicon nitride and silicon oxide ($SiO_x$).

Figure 1C:
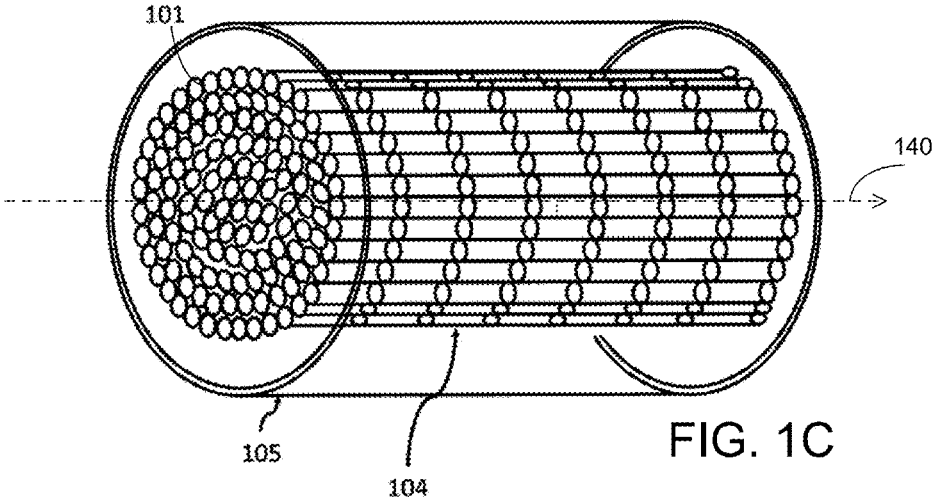
FIG. 1C is a perspective view of a representative charged particle trap that includes a plurality of sectioned tubular traps situated within an axially extending sidewall conductor.

FIG. 1C illustrates a representative charged particle storage device 100 that includes a two plurality of storage tubes such as the storage tube 101 that extend along an axis 140 within a conductive tube 105. Voltages applied to each segment within the conductive tube can be independently controlled with end conductors 102 so that charges in each section are retained independently. The storage device 100 is situated in a substantially uniform axial magnetic field (along the axis 150) and voltage are applied to end plates 102 to confine charged particles. Modulation of the voltages applied to the storage tubes 101 and end conductors 102 (also referred to as "trapping plates") permits controlled shuttling of charged particles between different segments of the tube and into and out of the storage device 100.

With reference to FIG. 1D, a storage device 128 includes a plurality of storage tubes 130-134 arranged in a 1 dimensional array. End cap conductors and interior surface conduction can be provided as described above. The tubes 130-134 can be defined by channels formed in a first substrate 136 and a second substrate 138, typically micro-machined channels in a silicon wafer. Arrays such as that of FIG. 1D can be stacked to form a two dimensional array. Each of the tubes 130-134 has a plurality of sections, and sectional end conductors are aligned so that common voltages can be applied to corresponding sections, but these additional details are omitted from FIG. 1D for clarity. With reference to FIG. 1E, the storage tubes 130-134 include respective sections 130A-130D, 131A-131D, 132A-132D, 133A-133D, 134A-134D. Suitable section voltages V1-V5 can be applied as indicated, but end cap conductors are not shown. In some examples, conductors can be coupled so that potentials in one or more or all sections can be established independently.

The representative storage devices described above are generally situated in substantially uniform axial magnetic fields. The conductive interior surfaces of the tubes provide Faraday shielding between separate tubes so that stored charges in different tubes do not tend to interact. Controlled and coordinated modulation of voltages applied section (and/or tube) end plates permits shuttling of charged particles out of one section into a next section, and out of the storage devices. It is generally preferred that sidewall conductivity be relatively high to reduce losses associated with induced currents due to stored charge motion.

Storage devices can be conveniently fabricated using etched or micro-machined silicon wafers. FIG. 2 illustrates silicon trenches that can be used to define storage tubes by stacking such trenches as illustrated in FIGS. 1D-1E. FIG. 3 illustrates wafers with hexagonal holes or pores that can be stacked to form storage devices such as shown in FIG. 1B.

Figure 4:
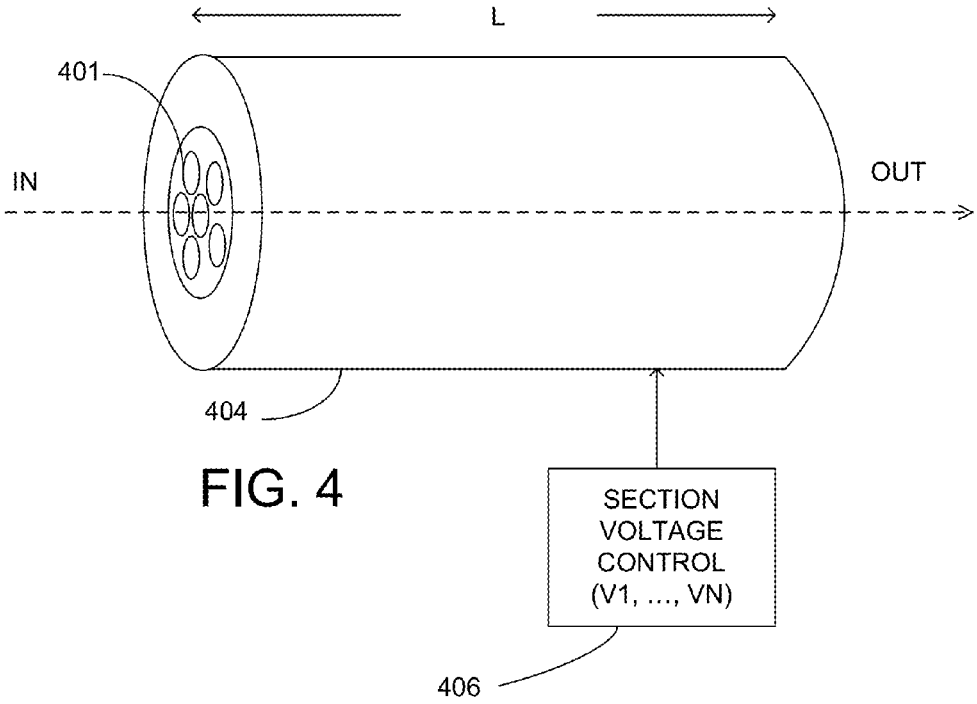
FIG. 4 is a representative Malmberg-Penning trap formed with a plurality of microtubes.

A schematic view of a representative micro-storage tube Malmberg-Penning trap array is illustrated in FIG. 4. A few or thousands of cylinders or other tubes 401 are drilled by deep reactive ion etching in 2 inch silicon wafers or other substrates. A plurality of such wafers are aligned and secured together and situated in a magnetic coil 404, typically a superconducting magnetic coil. A voltage controller 406 is coupled to provide suitable control, storage, and transport voltages to storage tube sections.

Figure 5:
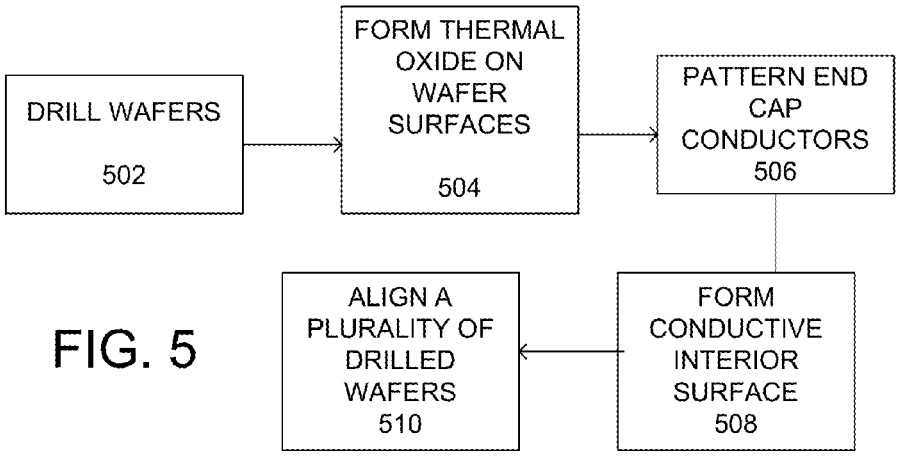
FIG. 5 is a schematic block diagram of a method of forming microtrap tubes.

A representative fabrication method is illustrated in FIG. 5. At 502, holes are drilled in a plurality of wafers with typical hole radii of 25 micrometer, but radii of 1 to 500 micrometers or other radii can be used. At 504, a thermal oxide is formed on front and back wafer surfaces, and at 506 end cap conductors are formed using a lithographic or other process. At 508, a conductive surface is provided on drilled hole interior surfaces, and at 510 the wafers are aligned and bonded together. Typically 25 micrometer radii holes are provided, and wafers stacked to provide an overall length of 10 cm. Deep reactive ion etching permits section length to radius ratios of 75 or larger, so that wafer stacks can have length to radius aspect ratios of at least 5000. For example, a 1 mm thick wafer with a 0.025 mm hole provides a section having an aspect ratio of 40, and a stack of 100 such wafers provides a total aspect ratio of 4000. Section aspect ratios greater than 25, 50, 75, or 100 are preferred, and overall aspect ratios of 100, 200, 500, 1000, 2500, 4000, or 5000 are preferred. Effective radii of 1-200 micrometers can be provided as well. In typical examples, 100-100,000 storage tubes or more can be provided in a stacked wafer assembly, with 1, 2, 5, 10, 20, 50, or 100 sections in each storage tube.

As noted above, tubes are not limited to circular cross sections, and for non-circular tubes, aspect ratio (tube or section) can be defined as a ratio of a total length (either of a section or a complete tube) to a square root of a cross-sectional area.

While the disclosed examples are described with reference to convenient dimensions, effective diameters as small as a few micrometers or less can be used. Minimum effective diameters are limited only by a selected fabrication technology, and values of 10 nm to 1 micrometer or smaller can also be used.

Generally, the disclosed devices exhibit superior performance if axial magnetic fields are aligned with tube axes with an angle that is less than the reciprocal of the aspect ratio (AR), or 0.5/AR, 0.1/AR, 0.05/AR, 0,01/AR, 0.005/AR, or less. Shimmed magnets are usually convenient as they permit compensation of unwanted magnetic fields such as the earth's magnetic field that can cause poor magnetic field alignment with a tube axis. Absent such alignment, stored charges can tend to interact with tube walls. Similarly, end cap electrodes should be perpendicular to the axial magnetic field so as to produce electrical fields that are directed to within an angle of about 1/AR, 0.5/AR, 0.1/AR, 0.05/AR, 0,01/AR, 0.005/AR, or less with respect to the tube axis (and the axial magnetic field axis). Larger angular deviations can result in additional stored charge interaction with tube walls. As noted above, an entrance segment of a multi-segment tube can be filled, and the introduced charge spread among some, all, or one segments, and the filling procedure repeated.

To maintain adequate electrical isolation between adjacent tubes, a wall thickness of at least 2 nm, 5 nm, 10 nm, 20 nm, 50 nm, or 100 nm is generally sufficient. With thinner walls, charges in adjacent tubes are less shielded from each other, and Coulomb interaction between tubes tends to increase. In addition, metallic layers preferably provide a substantially constant work function across the surface so that uniform electric fields can be provided using these layers.

Finally, it should be appreciated that by providing a plurality of parallel tubes in which charges from each tube are electrically shielded from each other, effective charge densities based on the total charge in all tubes greater than the Brillouin limit can be achieved, even with charge density in each tube at densities less than the Brillouin limit for the tube.

Stored Positron Applications

Potential applications ordered by the number of positrons required include 1) a portable positron container to deliver positrons for research applications and materials science, 2) a tool for the elimination of biological threats or the destruction of electronics by radiation from positron annihilation, 3) electric power generation from annihilation radiation, and 4) providing thrust for maneuvering a satellite or high altitude platform.

Figure 6:
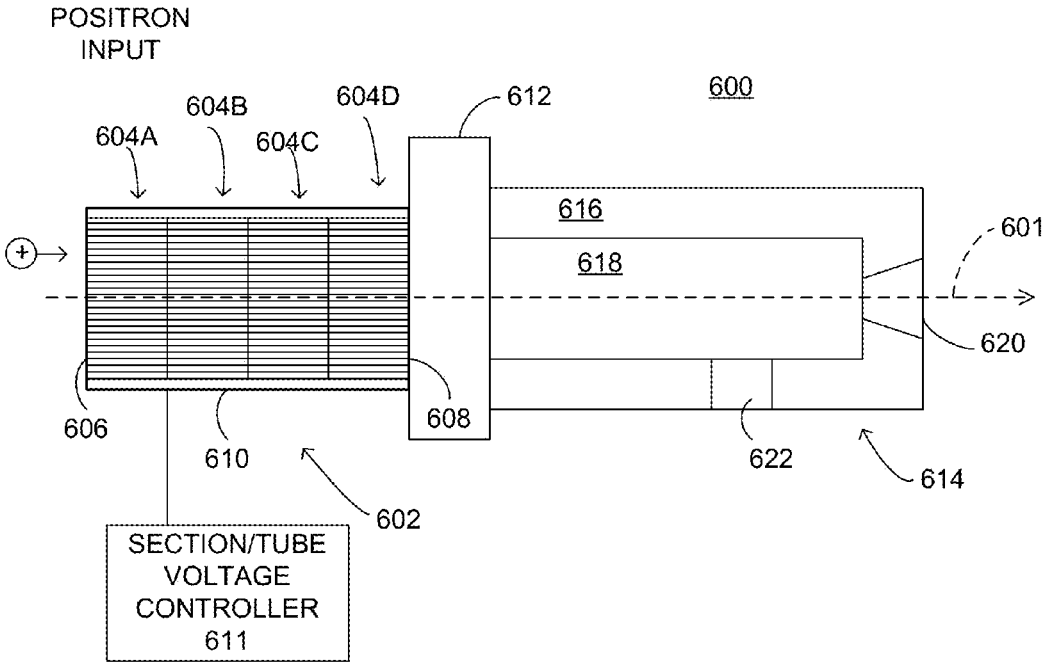
FIG. 6 is a sectional view of a representative positron annihilation powered nozzle that includes a multi-sectioned charged particle trap.
Figure 7:
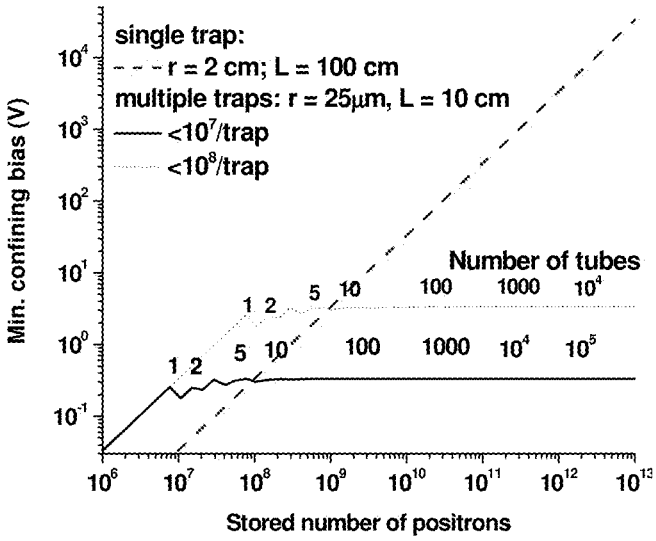
FIG. 7 is a graph of trap end cap potential versus a number of positrons confined in a single trap or in multiple microtraps. At 2 Tesla magnetic field, the positron density in each tube is less than 1% or 10% of a Brillouin limit for $10^7$ and $10^8$ positrons per tube, respectively. (The apparent bias discontinuities are due to the finite and small number of tubes.)

For example, as shown in FIG. 6, a nozzle 600 is configured to receive positrons released from a charged particle trap 602 such as those described above. The trap 602 includes a plurality of sectioned tubes that extend along an axis 601 and having a charged particle input surface 606. Trap sections 604A-604D are formed by corresponding sections of the storage tubes. The trap also includes a magnetic coil 610 configured to produce an axial magnetic field. A section/tube voltage controller 611 is coupled to direct storage of received positrons from a surface 608 and to release positrons to a tungsten target 614. The tungsten target 614 includes a tungsten substrate defined a cavity into which positrons from the trap 602 are directed by a charge particle optical system 612. In response to positron annihilation, the tungsten substrate is heated and a propellant introduced into a target chamber via an aperture 622 can expand and exit a nozzle 620. The expanded propellant can drive a turbine as well as provide propulsion, and the tungsten target can be configured to serve as a radiation shield. Alternatively, ions generated can be used to provide thrust. The heated substrate can also be used in other applications.

Positron Extraction

Stored positrons can be released in various ways. For example, a gradual or abrupt lowering of an exit barrier voltage can provide a quasi DC flux or a positron pulse. By applying a quadratic potential across a stack of trapped positrons along with lowering the exit potential, a last to leave positron can be accelerated sufficiently more than a first to leave positron so that both reach the target at about the same time. The positron beam can be focused with conventional electromagnetic lenses. Coulomb repulsive forces of the positron cloud can force positrons apart and widen pulse duration and degrade beam focus. By storing electrons in alternating traps and releasing the stored electrons along with stored positrons, a neutral plasma is generated.

Trap Filling

One representative method of trap filling consists of electrically squeezing confined positrons from an accelerator or other source such as a $^{22}$Na source into a small part of the length of the trap. The empty section of the trap can then be filled with more positrons. Eventually the separating bias will be lowered and the process can start over for a new filling cycle. A stack of segments that make up the trap is well suited for this approach. In another alternate method, positrons are permitted to continuously enter the trap for some time while the trap center potential is lowered compared to the end cap potential. Over time, the accumulated positrons will cool down sufficiently such that the potentials can be reset to starting conditions in preparation for a new filling cycle. In some cases, electric potential variations between segments can result in a spread of the cloud of stored positrons and lead to accelerated losses. In general, it is preferred to fill all parallel traps in a single filling operation. In addition, a monoenergetic positron beam that can be used to fill based on moderating beam energy with semiconductors such as silicon carbide (SiC). In a moderator such as SiC, positrons lose their initial kinetic energy and in a random walk some reach and emerge from a surface to form the beam. An electric field can be applied to a silicon carbide moderator so as to organize the random walk into a directed drift towards a desired surface.

Materials such as silicon carbide and diamond have a negative positron work function so it is energetically favorable for positrons to be in vacuum outside of the material rather than in the material. Hence, both silicon carbide and diamond are suitable selections for use as Field Assisted Moderators (FAM). In contrast to conventional metallic moderators, an external electric field can be used to pull positrons to an emission surface resulting in an enhancement of the moderation efficiency. Micromachining technology can be used to shape the FAM to preferentially concentrate positron emission opposite to the entrance tubes.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A charged particle storage device, comprising:

a plurality of substrates, each substrate defining a plurality of unsegmented through apertures from a first surface to an oppositely situated second surface, the substrates stacked so that a plurality of the through apertures from each substrate align to define a plurality of unsegmented through apertures extending through the stack of substrates from a first exterior surface oppositely situated with respect to a second exterior surface, the unsegmented through apertures having a length to radius aspect ratio of at least 25, wherein each of the unsegmented through apertures includes an unsegmented conductive interior surface; and electrically conductive layers situated at the first and second exterior surfaces.

2. The device of claim 1, further comprising electrically conductive layers situated at the first and second surfaces of each of the plurality of substrates, and electrically coupled so that different voltages can be established along the apertures of each substrate.

3. The device of claim 2, wherein the length to radius aspect ratio is at least 50.

4. The device of claim 3, wherein an effective diameter of the unsegmented though apertures is less than 100 micrometers.

5. The device of claim 3, wherein an effective diameter of the unsegmented through apertures is less than 50 micrometers.

6. A charge storage device, comprising:

a tubular void defined in a plurality of stacked substrates, the tubular void extending along an axis from a first surface to second surface that are substantially perpendicular to the axis, wherein each of the stacked substrates defines an unsegmented section of the tubular void, wherein the unsegmented tubular sections have a length to radius aspect ratio of at least 20 and an effective diameter of less than 125 micrometers; and conductive layers situated at the first and second surface and configured to establish an electric field along the axis, wherein the unsegmented tubular void is surrounded by a continuous conductive layer that extends along the axis.

7. The device of claim 6, wherein the length to radius aspect ratio is at least 50 and the effective diameter is less than 100 micrometers.

8. The device of claim 7, further comprising a plurality of unsegmented tubular voids defined in the plurality of stacked substrates, the unsegmented tubular voids extending parallel to the axis, wherein each of the stacked substrates defines a section of a corresponding unsegmented tubular void.

9. The device of claim 7, further comprising electrically independent conductive layers situated at the first and second surfaces of the plurality of substrates.

10. The device of claim 9, wherein the substrates are silicon substrates having thicknesses of less than 2 mm.

11. The device of claim 10, wherein the thicknesses are less than 1 mm.

12. The device of claim 11, wherein the effective diameter is less than 75 micrometers.

13. The device of claim 11, wherein each of the stacked substrates defines at least 100 unsegmented tubular void sections.

14. The device of claim 11, wherein each of the stacked substrates defines at least 1000 unsegmented tubular void sections.

15. The device of claim 11, wherein each of the stacked substrates defines at least 10,000 unsegmented tubular void sections.

16. The device of claim 11, wherein a cross section of the unsegmented tubular void sections is circular or hexagonal.

17. A charged particle storage device, comprising the device of claim 7, and further comprising:

a magnet configured to establish a magnetic field along the axis; and a voltage controller configured to supply at least one voltage so as to define axial electric fields in each of the tubular sections.

18. The charged particle storage device of claim 17, wherein the voltage controller is configured to establish axial electric fields that differ in magnitude and sign in each substrate.

19. A method, comprising:

forming a plurality of unsegmented recesses that extend between opposing surfaces of a wafer substrate, wherein a length to radius aspect ratio of the unsegmented recesses is at least 50 and an effective diameter is less than 100 μm;

establishing continuous conductive layers about the unsegmented recesses;

bonding a plurality of such wafer substrates to form a stack, wherein the unsegmented recesses in each wafer are aligned to form a plurality of through holes extending through the stack; and establishing conductive layers at opposing surfaces of the wafer stack.

* * * * *